US008575490B2

(12) United States Patent
Siahaan et al.

(10) Patent No.: US 8,575,490 B2
(45) Date of Patent: Nov. 5, 2013

(54) SPACER FOR USE IN A FLAT CABLE

(75) Inventors: Edward Siahaan, San Francisco, CA (US); Cameron Frazier, San Carlos, CA (US)

(73) Assignee: Apple Inc., Cupertino, CA (US)

( * ) Notice: Subject to any disclaimer, the term of this patent is extended or adjusted under 35 U.S.C. 154(b) by 282 days.

(21) Appl. No.: 12/856,419

(22) Filed: Aug. 13, 2010

(65) Prior Publication Data

US 2011/0174515 A1 Jul. 21, 2011

Related U.S. Application Data

(60) Provisional application No. 61/296,310, filed on Jan. 19, 2010.

(51) Int. Cl.
*H01B 7/08* (2006.01)

(52) U.S. Cl.
USPC ..... 174/117 F

(58) Field of Classification Search
USPC ..... 174/113 C, 115, 117 F, 28
See application file for complete search history.

(56) References Cited

U.S. PATENT DOCUMENTS

| | | | | |
|---|---|---|---|---|
| 4,396,797 | A | 8/1983 | Sakuragi et al. | |
| RE32,225 | E * | 8/1986 | Neuroth | 174/103 |
| 5,606,151 | A * | 2/1997 | Siekierka et al. | 174/113 R |
| 6,300,573 | B1 | 10/2001 | Horie et al. | |
| 6,844,500 | B2 * | 1/2005 | Williams et al. | 174/110 R |
| 6,974,912 | B2 | 12/2005 | Selby | |
| 7,291,044 | B1 | 11/2007 | Lin | |
| 2002/0125036 | A1 * | 9/2002 | Price et al. | 174/113 R |
| 2004/0045618 | A1 * | 3/2004 | Borchers | 138/110 |
| 2008/0179075 | A1 * | 7/2008 | Tsao | 174/115 |
| 2010/0101825 | A1 * | 4/2010 | Bonn | 174/113 R |

FOREIGN PATENT DOCUMENTS

JP 2006-100181 4/2006

* cited by examiner

*Primary Examiner* — Chau Nguyen
(74) *Attorney, Agent, or Firm* — Van Court & Aldridge LLP

(57) ABSTRACT

This is directed to a cable for use with an electronic device. The cable can be substantially flat, such that all of the conductive wires of the cable are substantially in the same plane. A spacer can be placed between the wires to ensure that wires conducting signals remain a minimum distance apart to avoid signal degradation. The spacer can also control the bending of the cables to favor bending in a preferred direction while reducing or limiting bending in a less preferred direction.

19 Claims, 4 Drawing Sheets

SPACER FOR USE IN A FLAT CABLE

CROSS-REFERENCE TO RELATED APPLICATION

This application claims the benefit of U.S. Provisional Application No. 61/296,310, filed Jan. 19, 2010, entitled "Spacer for Use in a Flat Cable," which is incorporated by reference herein in its entirety.

BACKGROUND

This relates to a flat electronic device cable designed to ensure that wires conducting signals remain a fixed distance apart.

An electronic device can be coupled to a cable to provide analog or digital signals from the device. For example, a cable can be used to connect the device to a host device or server (e.g., to transfer data). As another example, a cable can be used to provide an audio output from an electronic device (e.g., a cable connected to speakers or earbuds). The cable can provide a secure, fast and convenient communications path for the electronic device.

The cable can include any suitable number of conductive paths or wires, including different paths dedicated to different types of signals or information. For example, a cable can include conductive paths for transferring data, power, or other signals. When the conductive paths for transferring data are too close to one another, however, the signal integrity can be compromised. In particular, wires used to conduct data signals may need to be offset from one another, while shielding the wires from other wires used to conduct power.

SUMMARY

This is directed to a flat cable having a spacer positioned between conductive paths to maintain signal integrity.

Many electronic cables are constructed from several distinct wires surrounded by a non-conductive sheath. The wires can be distributed using any suitable approach including, for example, in a substantially circular or elliptical cross-section. In some embodiments, however, the cables can be distributed to form a substantially flat cable. In such an approach, wires may end up being too close to each other, thus causing the signal integrity of signals transferred through the wires to be compromised. In particular, because the wires may not be disposed to form a circular cross-section, two diametrically opposed wires of the cable may not be available to provide a consistent spacer between two other diametrically opposed wires.

To maintain the integrity of a transferred signal, the cable can include a spacer placed between conductive paths of the cable (e.g., the wires) to maintain a constant minimum distance between the conductive paths along the cable length. The spacer can have any suitable shape including, for example, a shape that includes one or more curved edges that maintain the position of the conductive paths. In some embodiments, the shape of the spacer can be defined based on mechanical considerations including, for example, based on a desired bending orientation (e.g., bending along the height or short side the cable, but not along the width or long side of the cable). Alternatively, the shape of the spacer can be selected to provide strain relief in one or more sections of the cable.

The spacer can be assembled in the cable using any suitable approach. In some embodiments, the spacer can be assembled in the cable by extruding the spacer simultaneously with one or more wires or jackets. This can allow the cable jackets to be provided in a different material than the spacer. Alternatively, the spacer can be simultaneously extruded with the wires to form an integral component.

BRIEF DESCRIPTION OF THE DRAWINGS

The above and other features of the present invention, its nature and various advantages will be more apparent upon consideration of the following detailed description, taken in conjunction with the accompanying drawings in which.

DETAILED DESCRIPTION

A cable can include several conductive wires each used to transmit different signals between electronic components. For example, a cable can include one or more wires providing audio paths (e.g., two wires for left and right stereo audio). As another example, a cable can include a wire used to transmit microphone signals. As still another example, a cable can include one or more wires for transferring data (e.g., several wires for transmitting data, and a wire serving to ground signals). The wires can be constructed using any suitable approach. In some embodiments, individual wires can be constructed by the extrusion or drawing of a conductive material. The wire can be coated with a dielectric or insulating material to ensure that signals conducted along each wire are not inadvertently or undesirably interfered with or accessed. Several wires can be combined in a bundle, for example placed in a tube or sheath to secure and protect the wires. The wires can be disposed in the cable using any suitable approach. In some embodiments, the wires can be disposed in a circular pattern.

Figure 1:
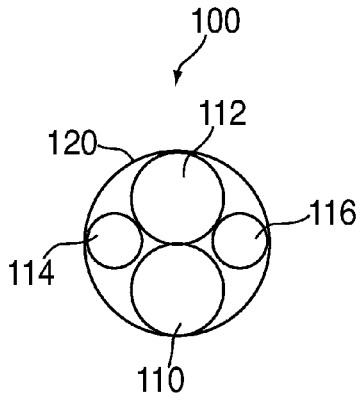
FIG. 1 is a cross-sectional view of a cable having a circular cross section.

FIG. 1 is a cross-sectional view of a cable having a circular cross section. Cable 100 can include individual wires or conductive paths 110, 112, 114 and 116. Each of the wires can have any suitable size including, for example, a size determined from the information or content transferred using the wire. In particular, a wire used to transfer power can be larger than a wire used to transfer data. In the particular implementation of FIG. 1, larger wires 110 and 112 can be used to transfer power, while smaller wires 114 and 116 can be used to transfer data. The wires can be enclosed in sheath 120 to provide an aesthetically and haptically pleasing cable, and to protect the individual wires. In some embodiments, sheath 120 can include several layers including, for example, a metal mesh layer (e.g., an aluminum layer), a Mylar layer, and a plastic cosmetic layer. The outermost layer of the sheath can be selected based on industrial design considerations including, for example, visual and tactile considerations.

Each individual wire 110, 112, 114 and 116 can include a conductive element (e.g., a copper wire) surrounded by a non-conductive sheath. The conductive element can be constructed using any suitable approach including, for example, drawing a conductive material and coating the drawn material with a dielectric material (e.g., dipping the drawn material in a liquid dielectric material). As another example, a dielectric material can be co-extruded with the drawn conductive material. As still another example, a dielectric material can be placed around a conductive wire wrapped around a structural core. The non-conductive sheath of each wire can ensure that the individual wires do not short within the cable. Because wires 114 and 116 conduct data signals, the wires may need to be placed at a minimum distance apart for the entire length of the cable to ensure signal integrity. In the case of cable 100, the disposition of larger wires 110 and 112 between smaller wires 114 and 116 can ensure that wires 110 and 112 maintain wires 114 and 116 apart by at least a minimum distance. The size or wires 110 and 112 can be selected such that the minimum distance between wires 114 and 116 is matched or exceeded by the wire size. For example, wires 110 and 112 can include 36 Ga wires, while wires 114 and 116 can include 30 Ga wires.

Figure 2:
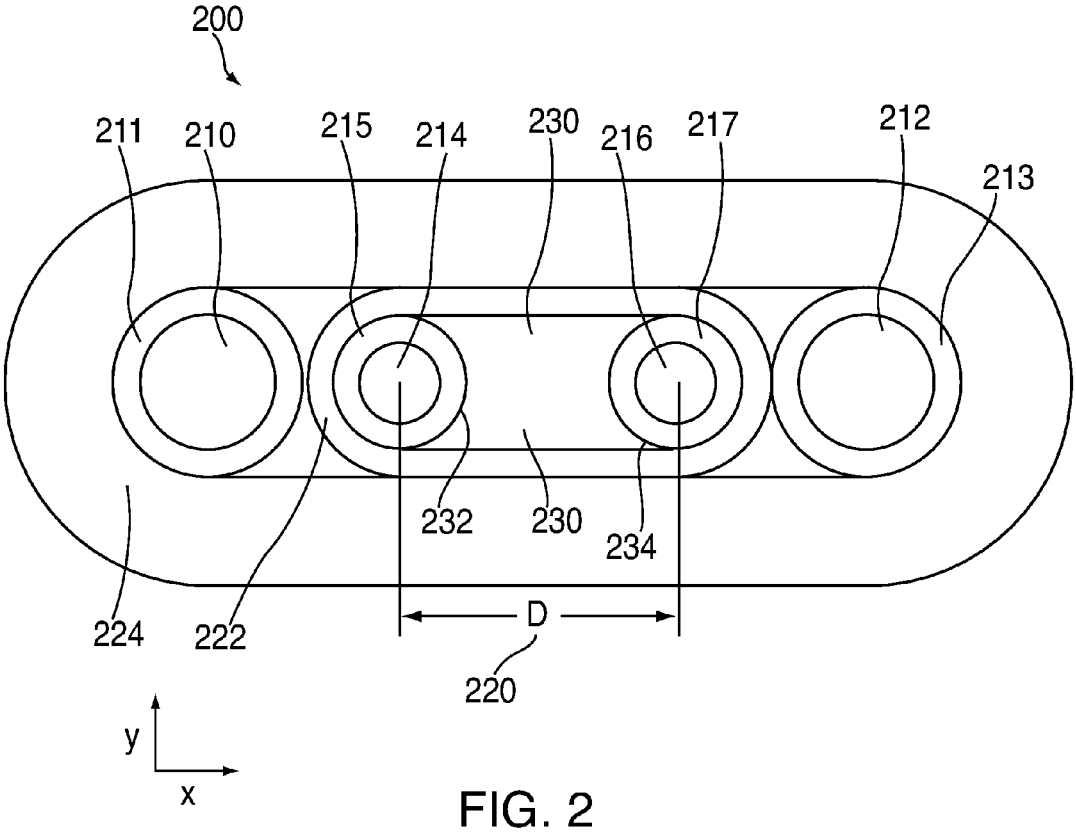
FIG. 2 is a cross-sectional view of an illustrative flat cable having a spacer in accordance with one embodiment of the invention.

In the implementation of FIG. 1, however, the cable includes a round cross-section. This allows the cable to bend in any direction, which may not be desirable, as it may place stress on wires within the cable, or on an interface between wires and a connector at an end of the cable. Instead, it may be desirable to control the bending of the cable by constructing a cable with a non-circular cross-section. For example, a cable can be constructed to be substantially flat (e.g., the individual wires of the cable lie in substantially the same plane). FIG. 2 is a cross sectional view of an illustrative flat cable in accordance with one embodiment of the invention. Cable 200 can include wires 210, 212, 214 and 216 for conducting different information through the cable. For example, wires 210 and 212, which can include some or all of the features of wires 110 and 112 (FIG. 1), can be used to conduct power. Each of wires 210 and 212 can be surrounded by non-conductive sheath or coating 211 and 213, respectively, to electrically isolate the wires. Wires 210 and 212 can be constructed from any suitable conductive material (e.g., copper), while sheaths 211 and 213 can be constructed from any suitable non-conductive material (e.g., plastic). The material selected for sheaths 211 and 213 can have any suitable mechanical property including, for example, be easily bendable to reduce stress on the wires. In some embodiments, each of the sheaths or coatings can be selected to be as thin as possible, for example to effectively eliminate mechanical effects of the sheath on the movement or the wires. Cable 200 can have any suitable dimension including, for example, approximately 2 to 5 mm width (e.g., along x) and 0.5 to 1.5 mm height (e.g., along y).

In some embodiments, wires 214 and 216 can be used to transfer data along the cable. Each of wires 214 and 216 can be surrounded by non-conductive sheath 215 and 217, respectively, for electrically isolating the wires. Each of wires 214 and 216, and sheaths 215 and 217 can have some or all of the features of wires 210 and 212, and sheaths 211 and 213. To reduce the interference of power transfers along wires 210 and 212 on data transmissions along wires 214 and 216, cable 200 can include conductive braid 222 positioned around wires 214 and 216 to shield the wires from wires 210 and 212 (e.g., from interference from wires 210 and 212, or from interfering with signals conducted by wires 210 and 212). The conductive braid can be constructed from any suitable material including, for example, a combination of conductive materials. The conductive braid can be placed over the wires using any suitable approach including, for example, by feeding the wires within the braid (e.g., within a tubing), extruding the braid material around the wires, or combinations of these. In some embodiments, the braid can be constructed as a first step (e.g., wrap the braid material to form a tubular structure), and the wires placed within the braid as a second step. In addition, braid 222 can serve to couple wires 214 and 216, and ensure that they remain together. Braid 222 can be constructed from any suitable material including, for example, from aluminum. To finish cable 200, jacket 224 can be placed over wires 210 and 212 and over braid 222 to provide a cosmetic surface that maintains the distribution and position of each of the wires (e.g., substantially in a single plane).

Because wires 214 and 216 conduct data, wires 214 and 216 may need to remain apart by at least distance 220 to ensure the integrity of transmitted signals, and to avoid interferences between the wires. Distance 220 can be any suitable distance including, for example, a distance determined from the size of wires 214 and 216, the sizes and material of sheaths 215 and 217, and the strength or type of signals being transmitted. In one implementation, distance 220 can be in the range of 0.5 mm to 2.5 mm (e.g., as measured between the centers of wires 214 and 216, or the smallest distance between the wires), such as in the range of 0.8 mm to 1.5 mm. In addition, because of a desired overall height of cable 200, the size of sheaths 215 and 217 cannot simply be increased until the sheaths ensure that distance 220 is respected, as this approach would necessarily increase the height of cable 200. Instead, cable 200 can include spacer 230 positioned between wires 214 and 216. Spacer 230 can be constructed from any suitable material including, for example, a hard non-conductive material to maintain distance 220. In one implementation, spacer 230 can be constructed from polypropylene or another plastic.

Spacer 230 can have any suitable size. In some embodiments, the height of spacer 230 can be limited to the height of the highest or tallest of wires 214 and 216 (e.g., a diameter of the largest of wires 214 and 216). This can ensure that the overall height of cable 200 is not increased beyond a minimum required for the wires of the cable. Spacer 230 can have any suitable width including, for example, a width determined from the minimum distance required for separating wires 214 and 216. In some embodiments, several spacers can be positioned side-by-side in a same or different planes to maintain apart more than two wires (e.g., two spacers used to separate three wires within a braid). Spacer 230 can have any suitable length including, for example, a length substantially corresponding to the length of cable 200. In some embodiments, spacer 230 can instead be limited to only a portion of the length of cable 200 (e.g., only in a region away from ends of the cable, or two distinct spacers positioned end to end and placed in the vicinity of the ends of the cable).

Spacer 230 can have any suitable shape for ensuring that minimum distance 220 remains respected. In some embodiments, spacer 230 can include curved edges 232 and 234 each substantially matching the shape of wire 214 (or sheath 215) and wire 216 (or sheath 217). The curved edges (e.g., wire receiving edges) can extend along any suitable amount of the wire surface (e.g., the external surface of a wire cross-section) including, for example, at least one fourth of the total wire surface. In some embodiments, the curved edges can cover close to half of the wire surface (e.g., form a half-circle receiving the wire). By curving spacer 230 around portions of the wires, the spacer may retain the wires in the plane of cable 200, and prevent the wires from being displaced around the spacer and coming in proximity to each other (e.g., closer than distance 220).

Spacer 230 can include any suitable intermediate region between the curved edges (e.g., holding the curved edges separated in a plane). In some embodiments, the intermediate region can be selected to control bending of cable 200 in directions x and y. In particular, the shape of spacer 230 (e.g., the shape of the intermediate region combined with the curved edges) can be selected to reduce or limit bending in x (e.g., within the plane of the wires), but facilitate bending in y (e.g., along the length of the wires). For example, the width of spacer 230 can be at least twice (e.g., three or four times) the height of spacer 230 (e.g., a width of 1.2 mm and a height of 0.5 mm). In the example of FIG. 2, spacer 230 can include a substantially solid block between edges 232 and 234. In particular, spacer 230 can fill the space between sheaths 215 and 217 within the boundary defined by braid 222. The resulting spacer can provide strain relief for cable 200, thus partially or totally obviating the need for an external strain relief component.

Figure 3:
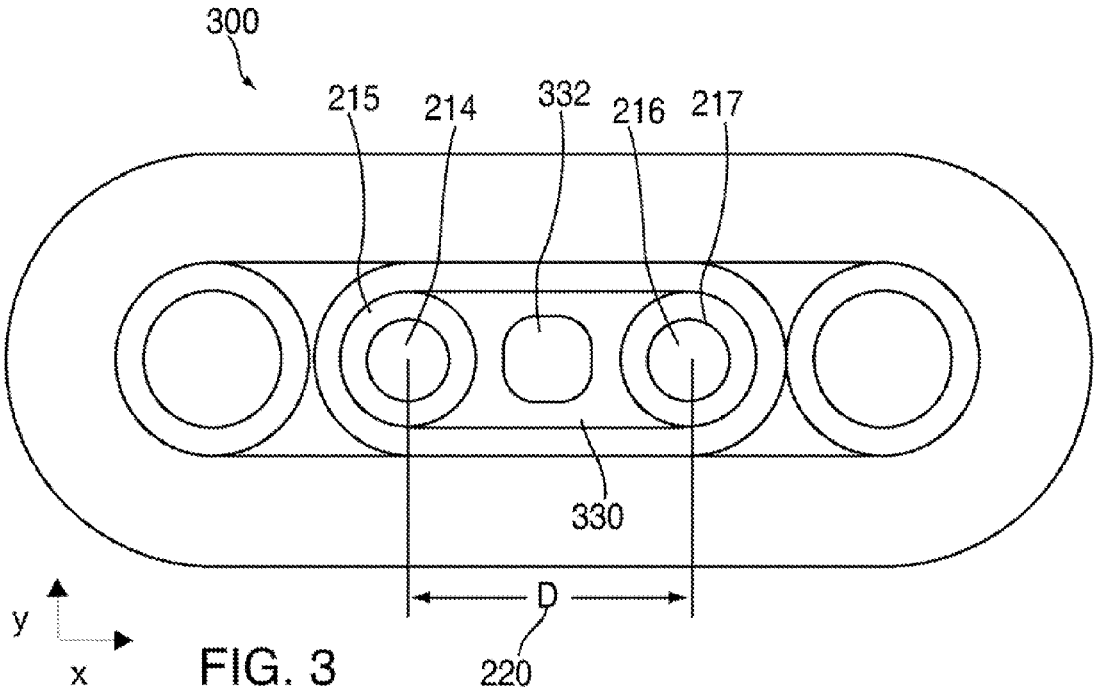
FIG. 3 is a cross-sectional view of an illustrative flat cable having a spacer in accordance with one embodiment of the invention.

In some embodiments, the spacer shape can vary between the curved edges. FIG. 3 is a cross-sectional view of an illustrative flat cable having a spacer in accordance with one embodiment of the invention. Cable 300 can include wires 214 and 216, and sheaths 215 and 217 as described above in connection with FIG. 2. Cable 300 can include spacer 330 positioned between the wires, such that the wires are maintained at least at minimum distance 220. To reduce the weight or material required for spacer 330, the spacer can include hollow opening 332 extending through at least a portion of the intermediate region of the spacer. Because spacer 330 includes material around the opening, spacer 330 can provide structural integrity between wires 214 and 216, as well as resistance to bending in the x direction. In some embodiments, opening 332 can improve or ease bending in the y direction by providing less material to displace while bending (e.g., reducing the bending moment in the y direction). Opening 332 can have any suitable shape, including a continuous shape along the length of the cable. In some embodiments, opening 332 can have a polygonal shape (e.g., a square or rectangular shape), a curved shape (e.g., a circular shape), or an arbitrary shape. In some embodiments, the shape of opening 332 can be optimized to resist or permit bending in particular orientations.

Figure 4:
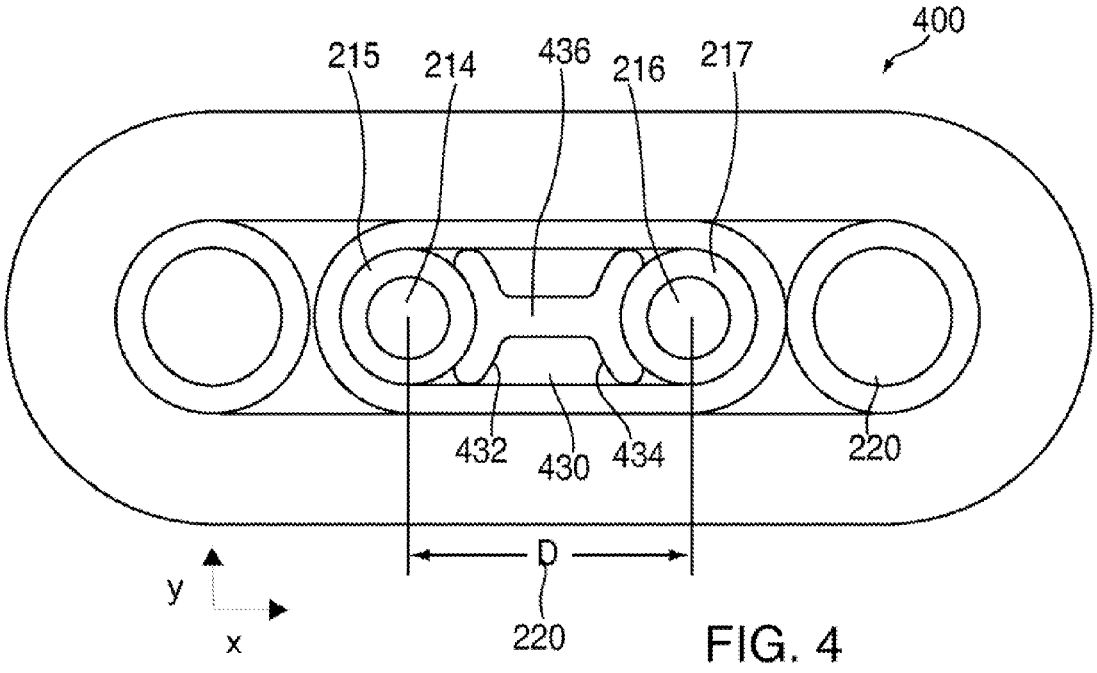
FIG. 4 is a cross-sectional view of an illustrative flat cable having a spacer in accordance with one embodiment of the invention.

FIG. 4 is a cross-sectional view of an illustrative flat cable having a spacer in accordance with one embodiment of the invention. Cable 400 can include wires 214 and 216, and sheaths 215 and 217 as described above in connection with FIG. 2. Cable 400 can include spacer 430 positioned between wires 214 and 216, such that the wires are maintained at least at minimum distance 220. To further reduce the size of spacer 430, the spacer can include curved edges 432 and 434 held apart by cross-bar 436 positioned substantially along the centerlines of wires 214 and 216. Cross-bar 436 can have any suitable thickness including, for example, at least a minimum thickness to resist bending in the x direction, retain wires 214 and 216 at least at distance 220, or both. In some embodiments, cross-bar 436 can be provided to define an I-beam geometry for spacer 430, which can improve or ease bending in the y direction by providing less material to displace during bending (e.g., reducing the bending moment). Cross-bar 436 can have any suitable size or geometry including, for example, a variable size or geometry (e.g., varying along the length of the cable, or varying between curved edges 432 and 434).

Figure 5:
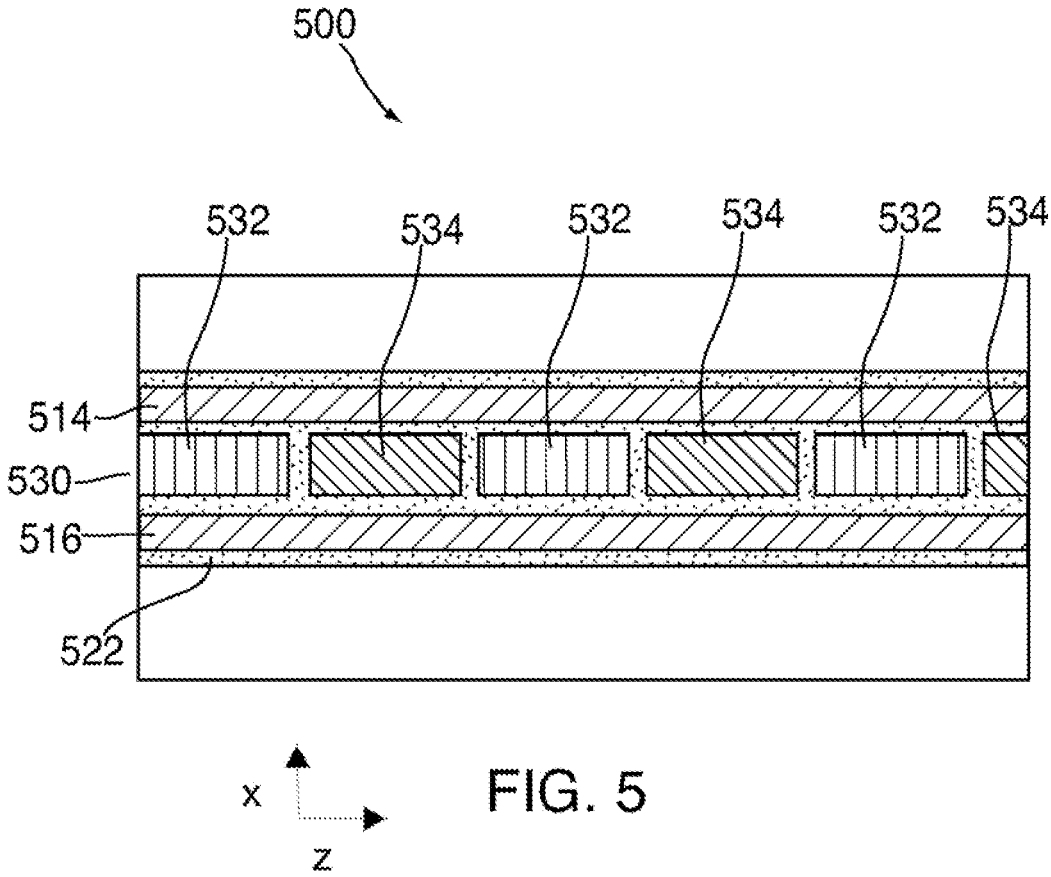
FIG. 5 is cross-sectional view of the components within a braid of a cable in accordance with one embodiment of the invention.

In some embodiments, the cable spacer can be constructed from several distinct elements, or in several distinct materials having different mechanical properties. FIG. 5 is cross-sectional view of the components within a braid of a cable in accordance with one embodiment of the invention. Cable 500 can include braid 522 in which signal wires 514 and 516 are retained. Spacer 530 can hold wires 514 and 516 apart at any suitable distance including, for example, at a minimal distance (e.g., distance 220). Spacer 530 can be constructed from distinct elements 532 and 534 (e.g., each element is a distinct spacer distributed end to end between the wires). Distinct elements 532 and 534 can be constructed from the same or different materials. For example, distinct elements 532 and 534 can be constructed from a same, hard material that does not bend. As another example, distinct elements can be constructed from materials having different stiffness to control the manner or location in which cable 500 bends. Distinct elements 532 and 534 can be constructed between wires 514 and 516 using any suitable approach including, for example, an extrusion process in which different materials are selectively used, a double shot molding process, or combinations of these. In the example shown in FIG. 5, cable 500 includes two different types of elements for spacer 530. It will be understood that spacer 530 can include any suitable number of types of elements, of any suitable size.

Each section or element of the spacer can have the same or different shapes. For example, different elements can have different geometries between curved surfaces retaining cable wires. In particular, element 532 can include a geometry similar to that shown in spacer 330 (FIG. 3), while element 534 can include geometry similar to that shown in spacer 430 (FIG. 4). The spacer can include any suitable number of different types of elements including, for example, two or more different types of elements. The different types of elements can be distributed in the cable using any suitable approach including, for example, in an alternating, patterned, or arbitrary manner. For example, different elements having different resistance to bending in a particular direction can alternate to reduce tangling of the cable, or to enhance rolling of the cable.

Individual elements of spacer 530 can be provided as distinct individual components, or can instead or in addition be interconnected. For example, the spacer can be constructed by connecting several different elements (e.g., elements constructed from different materials, or elements having different shapes). As another example, the spacer can be constructed by selectively connecting spacer elements to provide different levels of resistance in different regions of the cable.

In some embodiments, different elements of the spacer can be separated within the cable to allow the cable to bend between the elements. The elements can be separated by any suitable distance including, for example, distances that allow or prevent bending along an x-axis (e.g., less than the length of an element). In some embodiments, the distance between elements can be selected such that wires held apart by the elements do not come together and adversely affect the cable operation in the regions between the elements. In some cases, the distance can be selected instead or in addition based on cosmetic properties of the cable (e.g., to ensure that the cable does not sag in the absence of a spacer element).

Cable 200 (or cables 300 and 400) can be constructed using any suitable approach. In particular, spacer 230 (or spacer 330 and 430) can be inserted between wires 214 and 216 using different approaches. In some embodiments, the spacer can be constructed independently from the conductive wires, and later assembled with the conductive wires as part of the cable (e.g., inserted with the wires within the braid). In some embodiments, the spacer can instead or in addition be constructed as a single component with integrated wires. For example, the spacer can be co-extruded with the drawn wires to form a single, integral sub-assembly. The sub-assembly can be placed within the braid, and later assembled with other wires of the cable.

Figure 6:
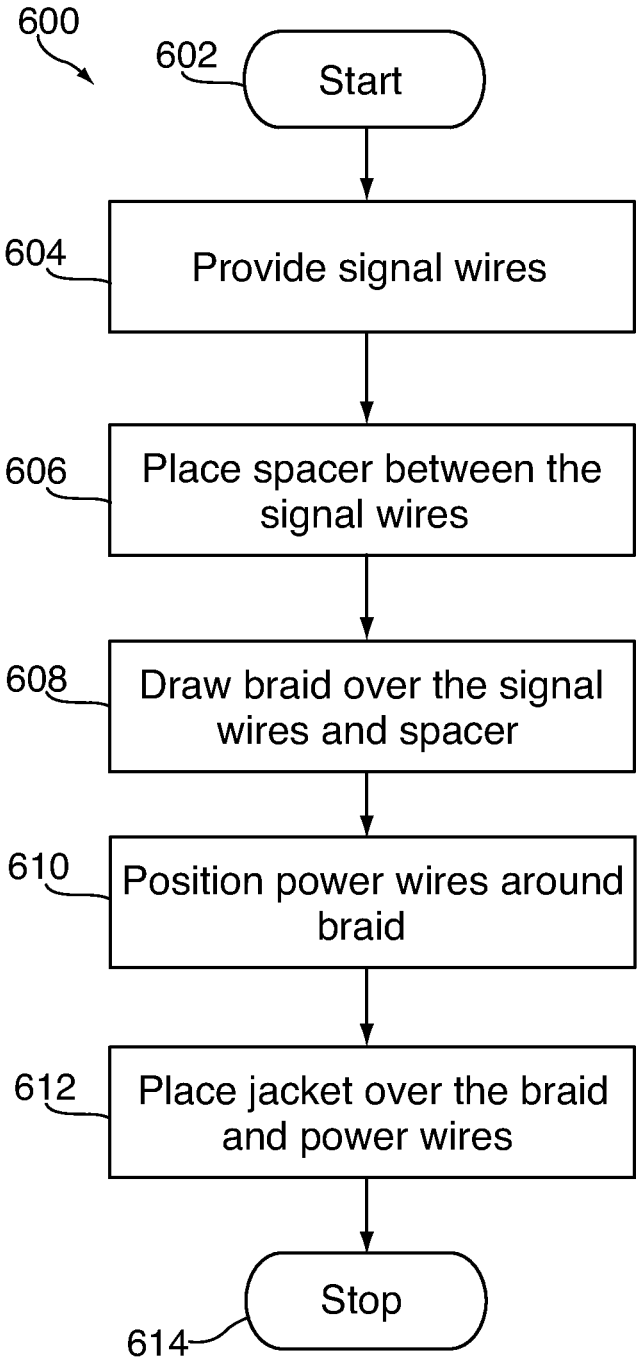
FIG. 6 is a flowchart of an illustrative process for manufacturing a cable in accordance with one embodiment of the invention.

FIG. 6 is a flowchart of an illustrative process for manufacturing a cable in accordance with one embodiment of the invention. Process 600 can begin at step 602. At step 604, signal wires can be provided. For example, two wires for conducting data signals can be provided. The wires can be constructed using any suitable approach, and can include a conductive path surrounded by a dielectric sheath. At step 606, a spacer can be placed between the signal wires. For example, a spacer provided substantially in a single plane can be placed in contact with the provided signal wires such that the signal wires are kept apart by at least a minimum distance. The spacer can be constructed using any suitable approach including, for example, as a single component, or as a combination of several elements. In some embodiments, the spacer can be extruded, for example co-extruded with provided signal wires. In some cases, the spacer can be molded or co-molded between the signal wires.

At step 608, a braid can be drawn over the signal wires and spacer. For example, a conductive braid providing electromagnetic interference shielding can be provided over the signal wires. The braid can be constructed using any suitable process including, for example, drawing. As another example, the signal wires and spacer can be fed within a previously manufactured braid. At step 610, power wires can be positioned around the braid. For example, power wires can be positioned on opposite sides of an elongated braid, such that the signal wires, spacer, and power wires are substantially in the same plane. The power wires can be provided using any suitable approach including, for example, co-drawn with the braid. At step 612, a jacket can be placed over the braid and the power wires. The jacket can be constructed from any suitable material including, for example, an insulating material. In some embodiments, the material or process used to construct the jacket can be selected based on industrial design considerations. In some embodiments, process 600 can instead or in addition include one or more steps for connecting ends of the cable to connectors, input interfaces (e.g., a microphone), or output interfaces (e.g., speakers). Process 600 can then end at step 614.

The previously described embodiments are presented for purposes of illustration and not of limitation. It is understood that one or more features of an embodiment can be combined with one or more features of another embodiment to provide systems and/or methods without deviating from the spirit and scope of the invention.

What is claimed is:

1. A cable for carrying electrical signals, comprising:
a plurality of wires substantially disposed in a plane; and
a spacer positioned in the plane between two of the plurality of wires, wherein:
the spacer comprises a first spacer element and a second spacer element;
the first spacer element maintains the two of the plurality of wires at no less than a minimum distance apart from one another along a first region of the length of the cable;
the second spacer element maintains the two of the plurality of wires at no less than the minimum distance apart from one another along a second region of the length of the cable;
the first spacer element provides the first region with a first resistance to bending in a first direction with respect to the length of the cable;
the second spacer element provides the second region with a second resistance to bending in the first direction with respect to the length of the cable;
the first resistance is different than the second resistance; and
the first region and the second region are different regions along the length of the cable.

2. The cable of claim 1, wherein:
the first spacer element comprises a hollow opening extending through at least a portion of the first spacer element and along at least a portion of the first region.

3. The cable of claim 1, further comprising:
a conductive braid positioned around the spacer and the two of the plurality of wires.

4. The cable of claim 3, wherein:
the two of the plurality of wires have a smaller diameter than others of the plurality of wires.

5. The cable of claim 1, wherein:
the two of the plurality of wires are operative to conduct data signals; and
at least one of the plurality of wires other than the two of the plurality of wires is operative to conduct power.

6. The cable of claim 1, wherein:
the spacer extends substantially along the entire length of the cable.

7. The cable of claim 1, the spacer further comprising:
a plurality of spacer elements disposed end to end along the length of the cable, wherein the plurality of spacer elements comprises at least the first spacer element and the second spacer element.

8. The cable of claim 1, further comprising:
an external sheath placed over the plurality of wires and the spacer.

9. The cable of claim 1, wherein the spacer further comprises:
at least two curved surfaces, each operative to receive one of the two of the plurality of wires; and
an intermediate region coupled to and separating the at least two curved surfaces.

10. The cable of claim 1, wherein the spacer provides strain-relief for the cable.

11. The cable of claim 1, wherein the spacer further comprises no spacer element along a third region of the length of the cable between the first region and the third region.

12. The cable of claim 1, wherein the first direction is along the length of the cable.

13. A cable having a rectangular cross-section, comprising:
a first set of wires having a first diameter, the first set of wires disposed in a first plane;
a second set of wires having a second diameter larger than the first diameter, the second set of wires disposed in the first plane; and
a spacer member disposed in the first plane, wherein the spacer member maintains the centers of two of the first set of wires apart by at least a spacer distance along a first length of the cable, and wherein at least one of the material of the spacer member and the shape of the spacer member varies along the first length of the cable for varying a resistance to bending in a first direction of the cable along different regions of the first length of the cable.

14. The cable of claim 13, further comprising:
disposing wires from the second set of wires on opposite sides of the first set of wires.

15. The cable of claim 14, further comprising:

a conductive braid disposed around the first set of wires and the spacer member.

16. The cable of claim 15, further comprising:

a cosmetic sheath placed over the second set of wires and the conductive braid.

17. The cable of claim 13, wherein the spacer member further comprises:

at least two wire receiving edges, each edge operative to be placed in contact with a wire of the first set of wires; and an intermediate region coupled to each of the at least two wire receiving edges, the intermediate region maintaining the wire receiving edges apart by at least the spacer distance.

18. The cable of claim 17, wherein:

a first wire receiving edge of the at least two wire receiving edges is operative to be placed in contact with an external surface of a first wire of the first set of wires; and the first wire receiving edge is operative to cover half of a cross-section of the external surface of the first wire when the first wire receiving edge is placed in contact with the external surface of the first wire.

19. The cable of claim 17, wherein:

the intermediate region comprises an opening through a length of the intermediate region.

* * * * *